US007028625B1

(12) United States Patent
Tomac

(10) Patent No.: US 7,028,625 B1
(45) Date of Patent: Apr. 18, 2006

(54) SYSTEMS AND METHODS FOR TREATING AND PREVENTING BLOCKAGES IN SOLID FUEL CONDITIONING EQUIPMENT

(75) Inventor: Danny Lee Tomac, Bluffton, IN (US)

(73) Assignee: Riley Power, Inc., Worcester, MA (US)

( * ) Notice: Subject to any disclaimer, the term of this patent is extended or adjusted under 35 U.S.C. 154(b) by 0 days.

(21) Appl. No.: 10/995,628

(22) Filed: Nov. 22, 2004

(51) Int. Cl.
*F23B 7/00* (2006.01)
*F23K 3/00* (2006.01)

(52) U.S. Cl. ..... 110/341; 110/116; 110/101 R

(58) Field of Classification Search ..... 110/341, 110/106, 101 R, 101 C, 101 CF, 348
See application file for complete search history.

(56) References Cited

U.S. PATENT DOCUMENTS 1,628,609 A * 5/1927 Newhouse ..... 110/106
3,050,018 A * 8/1962 Pearson ..... 110/101 CF
3,092,337 A * 6/1963 Patterson ..... 241/34
4,919,795 A 4/1990 Fujii et al.
5,025,930 A 6/1991 Barthelmess
5,289,978 A 3/1994 Lundquist
5,348,272 A 9/1994 Lukstas et al.
5,560,550 A * 10/1996 Krawczyk ..... 241/19
5,938,045 A 8/1999 Makino et al.
6,443,376 B1 9/2002 Huang et al.
6,644,479 B1 11/2003 Kimmeyer et al.

* cited by examiner

*Primary Examiner*—Kenneth Rinehart
(74) *Attorney, Agent, or Firm*—Edwards Angell Palmer & Dodge LLP

(57) ABSTRACT

Systems, methods and apparatus are provided for introducing one or more unblocking materials into solid fuel conditioning equipment at predetermined locations and intervals to prevent the occurrence of, or to treat the existence of at least one solid fuel blockage within the equipment, wherein introduction of the one or more unblocking materials is based on or triggered by an assessment of whether there is an actual or impending partial or complete blockage of solid fuel within the conditioning equipment, and wherein such assessment is made by measuring pressure within the solid fuel conditioning equipment and then comparing the measurement(s) against a baseline pressure.

28 Claims, 2 Drawing Sheets

SYSTEMS AND METHODS FOR TREATING AND PREVENTING BLOCKAGES IN SOLID FUEL CONDITIONING EQUIPMENT

FIELD OF THE INVENTION

The present invention relates to systems and methods for conditioning solid fuels, and, more particularly, to methods and apparatus for preventing the occurrence of, and/or treating the existence of one or more blockages within solid fuel conditioning equipment.

BACKGROUND OF THE INVENTION

Solid fuels, such as coal and coke, have many important uses in industry, including in high-temperature combustion operations. However, it is necessary to grind or otherwise condition solid fuels into smaller, finer particles to render them suitable for usage in these and other environments. Among the conditioning equipment that is currently available for doing so is the Atrita® Pulverizer, which is shown as reference numeral 10 in FIG. 1.

When used, the Atrita® Pulverizer 10 is effective to transform raw coal (or other solid fuel) that is otherwise unsuitable for use as a fuel into pulverized coal, which, in turn, can be readily consumed in high-temperature combustion processes. The Atrita® Pulverizer 10 operates through successive crushing, impact and attrition processes, which occur, respectively, in a crusher section 20, a pulverizing section 30, and a fan section 40 of the Pulverizer.

Unfortunately, unforeseen and/or unavoidable conditions may arise that can adversely affect optimum functioning of solid fuel conditioning equipment, such as the Atrita® Pulverizer 10. For example the presence of excess moisture (due to, e.g., humidity in the atmosphere and/or contaminants within the solid fuel being treated) can disrupt, if not entirely cease the flow of solid fuel through the conditioning equipment, thus causing formation of a partial or complete blockage of solid fuel. In the case of the Atrita® Pulverizer 10, were a solid fuel blockage to occur due to excessive moisture, the location of the blockage would most likely be within the grid portion 50 of the crusher section 20, where there are small openings through which the solid fuel is forced prior to entering the grinding section 30.

Even a partial blockage in solid fuel conditioning equipment is undesirable. In the case of the Atrita® Pulverizer, a partial blockage could necessitate added power consumption due to the fan section 40 of the Pulverizer being required to work harder to move along the solid fuel. Moreover, if there is a complete blockage of solid fuel, then the Atrita® Pulverizer (or other conditioning equipment) would need to be shut down, unblocked, and then cleaned prior to resuming operation. This would cause added expense due to increased manpower and lost production. Moreover, if a complete blockage was unnoticed and the Atrita® Pulverizer 10 (or other conditioning equipment) continued to operate, then some of its parts (e.g., couplings) could be ruined. This would cause still further added expense in repairing or replacing the affected equipment.

Therefore, a need exists for a system that can be easily implemented into existing solid fuel conditioning equipment, and that allows solid fuel blockages to be prevented, or at least to be noticed and properly acted upon prior to the efficacy of the equipment being compromised.

SUMMARY OF THE INVENTION

The present invention meets this and other needs by providing systems, methods and apparatus for introducing one or more unblocking materials into solid fuel conditioning equipment at predetermined locations and intervals in order to prevent the occurrence of, or to treat the existence of at least one blockage in the conditioning equipment. Introduction of the one or more unblocking materials is based on or triggered by an assessment of whether there is an actual or impending partial or complete blockage of solid fuel within the conditioning equipment. In an exemplary aspect of the invention, this assessment is made by measuring pressure within the solid fuel conditioning equipment and then comparing the measurement(s) against a baseline pressure to see whether (and, if so, by how much) the measurement(s) are less than the baseline pressure.

The one or more unblocking materials can be introduced directly into the conditioning equipment (e.g., at or near the suspected or confirmed location of the actual or impending blockage); however, according to a currently preferred aspect of the present invention, the unblocking material(s) are instead introduced external to the conditioning equipment.

Determination of the appropriate amount of the one or more unblocking materials to introduce can be based on several factors, including but not limited to the type of solid fuel being conditioned. In general, the unblocking material(s) should be harder and heavier than the solid fuel being conditioned.

Various other aspects and embodiments of the present invention are discussed below.

BRIEF DESCRIPTION OF THE DRAWINGS

For a fuller understanding of the nature and desired objects of the present invention, reference is made to the following detailed description, which is to be taken in conjunction with the accompanying drawing figures wherein like reference characters denote corresponding parts throughout the several views presented within the drawing figures, and wherein.

DETAILED DESCTRIPTION OF THE INVENTION

Figure 1:
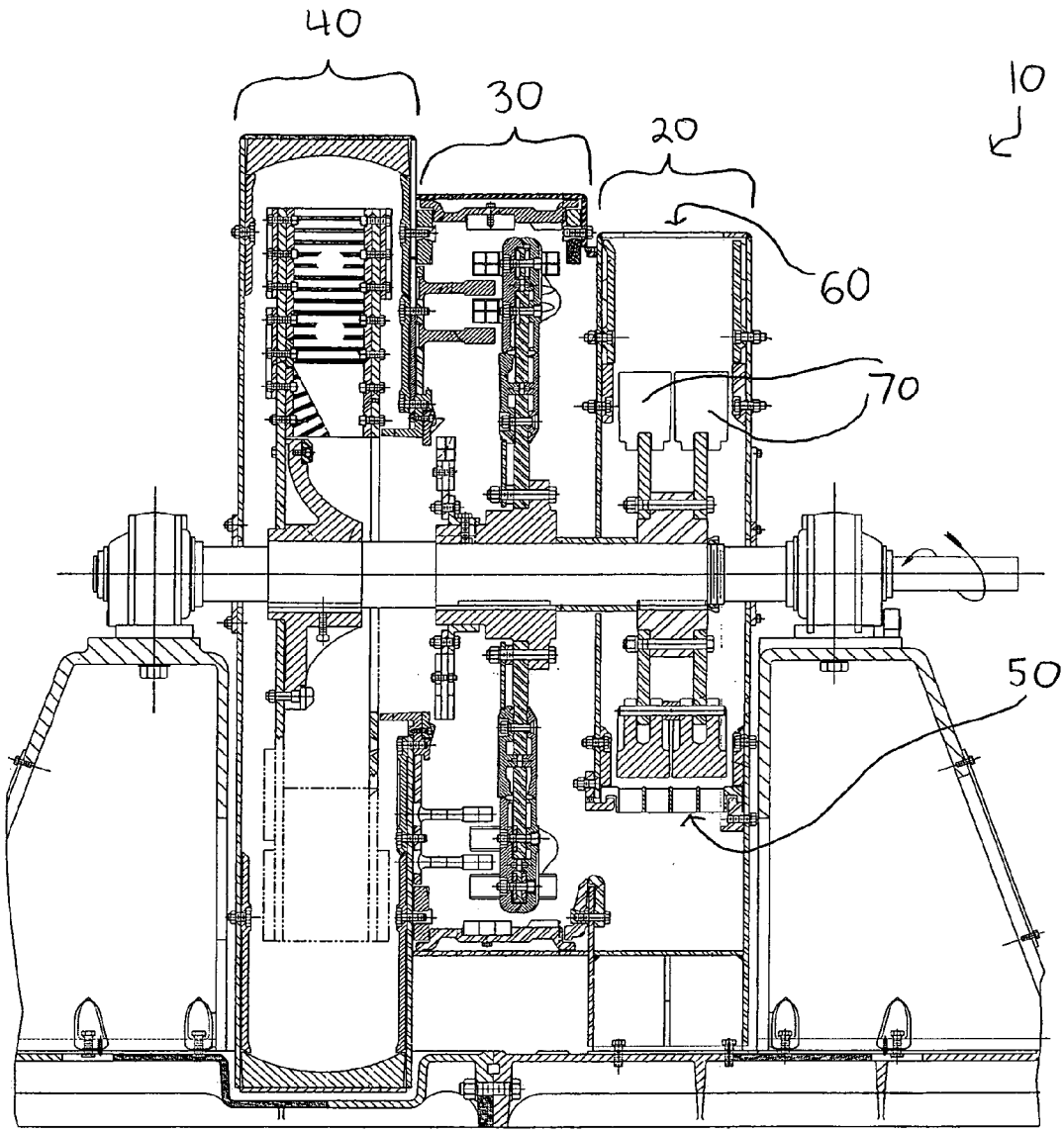
FIG. 1 is a side elevational view of internal sections and components of an Atrita® Pulverizer solid fuel conditioning equipment.

In accordance with an exemplary embodiment of the present invention, one or more unblocking materials are introduced into solid fuel conditioning equipment at predetermined locations and/or intervals in order to prevent the occurrence of, or to cure the existence of a solid fuel blockage within the conditioning equipment.

For purposes of the present invention, "blockage" is defined as solid fuel being retained within the conditioning equipment to an extent whereby normal/expected flow of the solid fuel through the conditioning equipment is either disrupted (i.e., a partial blockage) or caused to substantially or entirely cease (a complete blockage). A blockage is considered "cured" when there has been dislodgement of a predetermined amount of solid fuel that had already formed a partial or complete blockage within one or more locations in the solid fuel conditioning equipment. A blockage is "prevented" if, by operation of systems, methods and/or apparatus of the present invention, the blockage either does not occur, or its onset is caused to be delayed.

The systems, methods and apparatus of the present invention are applicable to a wide range of solid fuel conditioning equipment. For example, such conditioning equipment can be stand-alone, or part of a large-scale system. Currently preferred solid fuel conditioning equipment to which the present invention is applicable is the Atrita® Pulverizer (see reference numeral 10 in FIG. 1 and reference numeral 120 in FIG. 2), which is commercially available from Riley Power Inc. of Worcester, Mass., USA.

Examples of solid fuels that can form blockages within such conditioning equipment and that can be unblocked in accordance with the present invention include, but are not limited to, coal, bituminous coal (e.g., eastern and mid-western bituminous coal), sub-bituminous coal, lignite, and coke (e.g., delayed coke).

According to a currently preferred embodiment of the present invention, one or more unblocking materials are caused to be introduced into solid fuel conditioning equipment after the formation of a partial blockage of solid fuel within the solid fuel conditioning equipment, yet prior to the formation of a complete blockage. This, in turn, ensures that one or more unblocking materials are not needlessly caused to be introduced to solid fuel conditioning equipment in order to cure a blockage that does not actually exist or is not threatened, but it also makes certain that a complete blockage—which would be comparatively more difficult to cure versus a partial blockage—has not already occurred.

It should be noted, however, that the systems, methods and apparatus of the present invention are effective to cure a complete blockage and/or to prevent the onset of a partial or complete blockage as well.

According to an exemplary embodiment of the present invention, one or more unblocking materials are caused to be introduced into the conditioning equipment, as opposed to being introduced directly into the equipment. This is advantageous because introduction in such a manner does not require structural modification of the existing conditioning equipment, nor does it otherwise disturb the conditioning process. Alternatively, however, the one or more unblocking materials can be supplied directly into the equipment, e.g., at or near what has been identified as, or what is believed to be a blockage site.

In accordance with a currently preferred embodiment of the present invention, unblocking materials are ultimately introduced into the conditioning equipment via the same conduit/line as the solid fuel being conditioned. Thus, in an embodiment of the present invention wherein the solid fuel conditioning equipment is the Atrita® Pulverizer 10 (see FIG. 1), the one or more unblocking materials are ultimately introduced via the same inlet 60 in which the solid fuel is supplied to the pulverizing section 20 of the Atrita® Pulverizer.

The one or more unblocking materials can be introduced at a variety of predetermined intervals to prevent a blockage from occurring. To that end, a certain amount (e.g., weight, volume, etc.) of unblocking material(s) can be introduced after the solid fuel conditioning equipment has been operating for a predetermined amount of time following the most recent instance in/during which unblocking material was introduced. Alternatively, a predetermined amount of one or more unblocking materials can be introduced either after a predetermined amount (e.g., weight, volume, etc.) of, or predetermined time during which, solid fuel has been cycled through the conditioning equipment since the most recent instance wherein unblocking material was introduced.

However, according to a currently preferred embodiment of the present invention, the unblocking material(s) are introduced specifically to cure a partial or complete blockage that has already occurred or is imminently threatened. The existence of a blockage in the solid fuel conditioning equipment should be gauged via reliable techniques and equipment, which, as is currently preferred, do not require cessation of the operation of the conditioning equipment.

By way of non-limiting example, the existence of a blockage can be assessed by gauging the pressure within the conditioning equipment and comparing that data with a previously ascertained baseline measurement. Pressure is a reliable assessment variable, since a decrease in pressure—as compared to a baseline pressure—would be strongly indicative not only of the formation of a blockage, but also of its severity. For example, a small decrease/differential as compared to the baseline pressure would be suggestive of an impending or partial blockage, whereas a large decrease/differential as compared to the baseline pressure would suggest formation of a complete blockage. Generally, several pressure differentials would be obtained over a predetermined time, with an increasing differential (i.e., more and more of a decrease) being indicative of either a blockage starting to form, or an already formed partial blockage becoming (or having become) a complete blockage.

Based on this information, the amount (e.g., weight, volume, etc.) of unblocking material(s) to introduce can be determined. For example, if a large pressure differential is observed, one would introduce a higher volume or weight of unblocking material(s) to cure the impending or actual complete blockage. In contrast, a comparatively lower amount of unblocking material(s) would be introduced in response to a comparatively smaller pressure differential, which merely indicates an impending or actual partial blockage formation.

Figure 2:
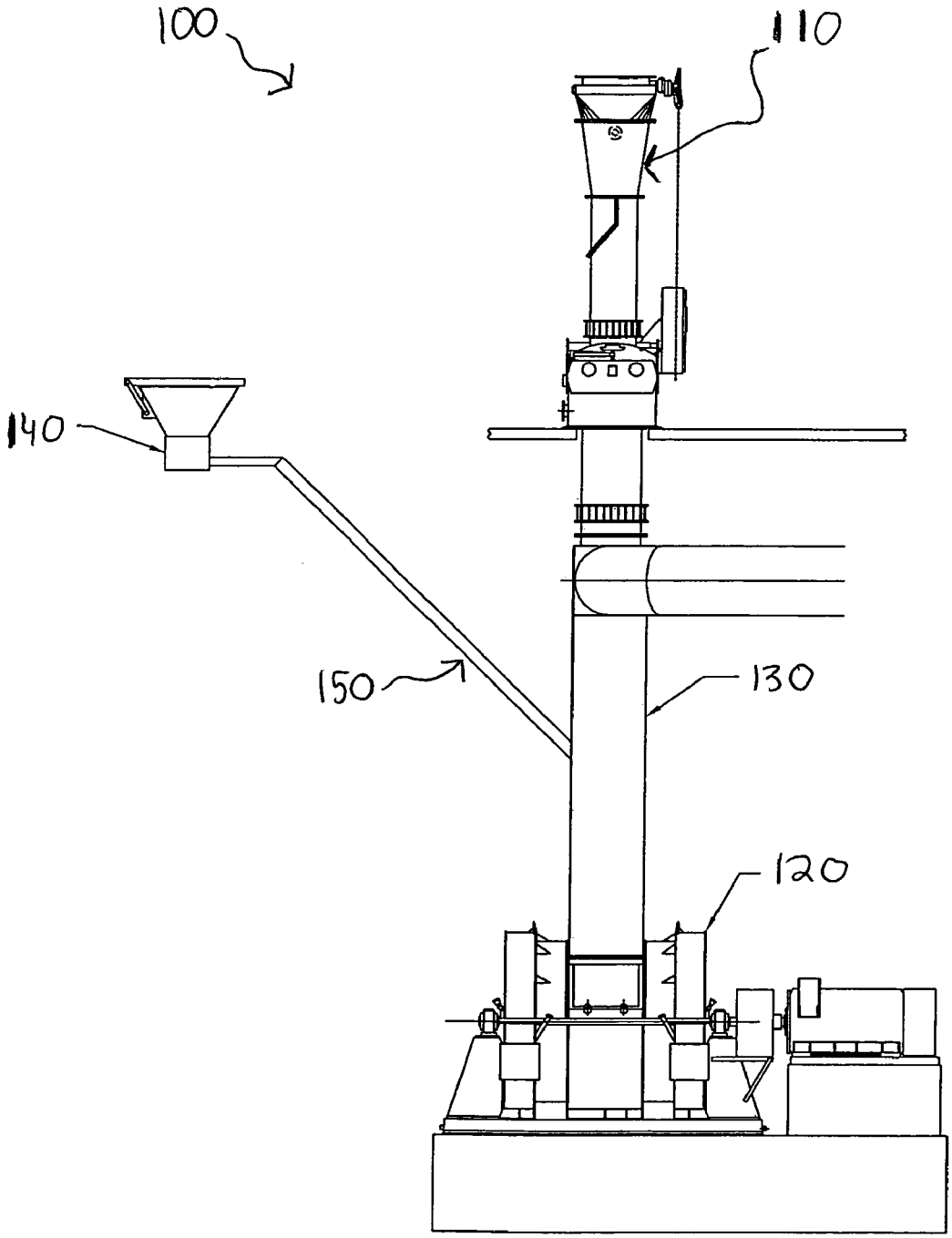
FIG. 2 is a schematic view of an implementation of the Atrita® Pulverizer of FIG. 1 within an unblocking system of the present invention.

FIG. 2 depicts a system 100 for introducing unblocking material(s) into solid fuel conditioning equipment. The system 100 includes a solid fuel source 110, which supplies solid fuel (not shown) into conditioning equipment 120 via a feed line 130 (also shown as reference numeral 60 in FIG. 1). As discussed above, the conditioning equipment 120 can be any solid fuel conditioning equipment, including, but nor limited to, an Atrita® Pulverizer (see FIG. 1).

The system 100 also includes a containment device 140, in which the one or more unblocking materials (not shown) are stored/held. As noted above, it is currently preferred, but not required, to cause the unblocking material(s) to be introduced external to the conditioning equipment 120. To that end, and as shown in FIG. 2, containment device 140 is in communication with feed line 130—which leads into the conditioning equipment 120—via a separate conduit/line 150. This allows the unblocking material(s) to be introduced into the conditioning equipment 120 via the same ultimate pathway as the solid fuel. According to an alternate embodiment of the present invention, the unblocking material(s) can be introduced directly into the conditioning equipment 120 (e.g., at or near a blockage).

The one or more unblocking materials are caused to be introduced into the conditioning equipment 120 at a predetermined interval and/or in response to conditions suggestive of an actual or impending partial or complete blockage. According to an exemplary embodiment of the present invention, the containment device 140 is caused to (or signaled to) commence supplying the one or more unblocking materials to conduit/line 150. Suitable containment devices 140 include, but are not limited to, one or more screw feeders, which can be activated as is generally known in the art (e.g., via signals from a programmable logic device).

What follows is a description of an exemplary method of employing the system 100 of FIG. 2 to cure one or more blockages in solid fuel conditioning equipment 120, such as the Atrita® Pulverizer depicted in FIG. 1.

Initially, a baseline pressure reading is obtained via pressure measurement equipment known in the art. Exemplary such equipment can include, but is not limited to, one or more inclinometers. The baseline pressure measurement can be assessed at one or more predetermined locations within the conditioning equipment 120. A currently preferred location for measuring the baseline pressure is at a solid fuel outlet, i.e., a location at which conditioned solid fuel leaves/exits the conditioning equipment 120.

According to a currently preferred embodiment of the present invention, the baseline pressure is assessed while the conditioning equipment 120 is functioning, but at a predetermined instance when there can be assurance that neither a partial or complete blockage is already present. This will ensure that the baseline pressure measurement is accurate for a particular rate or weight of the solid fuel that is being conditioned by the conditioning equipment. That, in turn, makes certain that subsequent pressure measurements can be reliably indicative of an actual or impending partial or complete blockage of solid fuel within the conditioning equipment.

By way of non-limiting example, the baseline pressure measurement can be obtained while the conditioning equipment is functioning at substantially full load, thus providing a "dirty-air" pressure measurement. Such a measurement is a useful determination, in that it simulates likely operating conditions of the conditioning equipment 120.

Once the baseline pressure is ascertained, and during operation of the conditioning equipment 120, the current pressure is assessed (e.g., constantly or at predetermined intervals). This also is achieved using equipment known in the art, e.g., the same or different inclinometer(s) that assessed the baseline pressure.

The current pressure measurement(s) should then be compared against the baseline pressure measurement to determine the difference between them (i.e., the pressure differential). This comparison can be made by an operator (e.g., by viewing a visual indication of the pressure differential) or, according to a currently preferred embodiment, via various instrumentation and control equipment.

Suitable instrumentation and control equipment for performing the necessary pressure comparisons is known in the art. By way of non-limiting example, the pressure measurement equipment can be in communication with a pressure transmitter (e.g., a smart pressure transmitter such as the Model ST3000, which is commercially available from Honeywell of Morristown, N.J., USA), which sends readable electronic signals representative of the current pressure to a programmable logic device, such as a PLC-5 system, which is commercially available from Allen Bradley of Milwaukee, Wis., USA.

The programmable logic device operates by comparing the input pressure measurement signals against inputted or stored parameters. This comparison can be made as is generally known in the art, e.g., via stored ladder logic. The programmable logic device then causes an appropriate response to occur based on this comparison. To accomplish this, the programmable logic device executes one or more application programs (e.g., software) that, at minimum, will cause one or more actions to be taken in response to certain conditions/events.

The application program(s) for execution in the programmable logic device call for the programmable logic device to read and interpret signals from the pressure transmitter (s) and/or other system devices, and to compare the values represented by those signals with protocol values (e.g., preset limits) stored in a memory (e.g., a flash or non-volatile type of memory, as is known to those of ordinary skill in the art) of the programmable logic device. In response, the application program(s) prompt the programmable logic device to send signals to control and operate equipment, as described below.

The application program(s) more specifically include instructions and criteria to query of certain criteria (e.g., the inputs from the system sensors or other signals), and to compare them to stored levels/values. Based on this comparison, the programmable logic device—more specifically, the application program(s) being executed therein—will cause the system to respond as programmed or in a predetermined fashion.

In an optional embodiment of the present invention, the programmable logic device also can include a user interface, which a system operator can view and can utilize to change system operation parameters.

In accordance with an exemplary embodiment of the present invention, the programmable logic device is responsible for signaling the containment device 140 to open or to activate, such that one or more unblocking materials are supplied from the containment device to the conditioning equipment 120, e.g., via conduit/line 150. The conduit/line 150 leads into feed line 130, which, in turn, ultimately leads into the conditioning equipment 120.

The programmable logic device signals the containment device 140 once it receives signals (e.g., from the pressure transmitter(s)) that are indicative of a predetermined pressure differential/decrease. As noted above, this pressure differential can be representative of a blockage starting to form, or of an already formed partial blockage becoming (or having become) a complete blockage.

In accordance with a currently preferred embodiment of the present invention, the predetermined pressure differential is measured as the percentage that the current pressure measurement varies below (i.e., has decreased from) the baseline pressure measurement. By being based upon percentage (rather than, for example, a numerical amount), the pressure differential is better able to account for variations (e.g., site-by-site or installation-by-installation variations). Such variations can be, e.g., with respect to the equipment being used, the moisture in the air and/or in the solid fuel, and the type and size of the solid fuel. A pressure differential (i.e., decrease from the baseline pressure) in the range of about ten percent to about fifty percent would be suggestive of the existence of an actual or impending blockage, with a differential (i.e., decrease from the baseline pressure) in the range of about ten percent to about twenty-five percent being generally suggestive of a blockage that is in the process of forming, and a differential (i.e., decrease from the baseline pressure) in the range of about twenty-five percent to about fifty percent being generally suggestive of a blockage that has already formed.

Thus, the programmable logic device can be programmed to trigger the release of unblocking materials from the containment unit 140 in response to a certain pressure differential percentage, with the exact pressure differential threshold depending, e.g., on the goal of the system (i.e., preventing a blockage versus curing a blockage).

Alternatively, the unblocking materials can be caused to be released from the containment device 140 by an operator who has been signaled to take action in response to a predetermined pressure differential/decrease. This signaling can be provided, e.g., via visual or aural indicia. Exemplary visual indicia include, but are not limited to, a computer monitor, a wired or wireless device, a beacon, a read-out or one or more other assigned images, and exemplary aural indicia include, but are not limited to, an alarm, siren or one or more other assigned sounds.

The amount (e.g., weight and/or volume) of unblocking material(s) that are caused to be introduced to the conditioning equipment 120 can vary, as can the frequency of introduction. According to a currently preferred embodiment of the present invention, the amount of unblocking material introduced to the conditioning equipment 120 will vary in proportion to the actual or perceived severity of the blockage. Thus, the amount of unblocking material that is introduced to cure what is believed to be a complete blockage within the conditioning equipment will be higher/larger than the amount introduced in response to what is thought to be a partial blockage in the conditioning equipment. However, that lesser amount generally will be larger than the amount that would be introduced to prevent a blockage that has yet to occur.

In an embodiment of the present invention in which the conditioning equipment 120 is an Atrita® Pulverizer (see reference numeral 10 in FIG. 1), the total amount of unblocking material that is introduced to cure a blockage is generally in the range of about one pound to about five pounds, with a range of about one pound to about three pounds being currently preferred to cure a partial blockage and a range of about three pounds to about five pounds being currently preferred to cure a complete blockage.

It should be noted, however, that these ranges can vary as appropriate. Among the factors that can influence whether a higher/larger or lower/smaller amount of unblocking material should be introduced are: the solid fuel being conditioned, the choice of unblocking material, the pressure differential data, and the actual or perceived location of the solid fuel blockage(s).

Moreover, the choice of the one or more unblocking materials will vary depending on several factors, including but not limited to what type of solid fuel material is being conditioned, as well as whether a partial or complete solid fuel blockage is believed to have occurred.

In general, the one or more unblocking materials should be heavier than whatever solid fuel is being conditioned, as that will help ensure that the unblocking material(s) will be able to displace the solid fuel blockage(s). In a similar vein, the one or more unblocking materials should be harder than the solid fuel being conditioned. However, the unblocking material(s) should not be so hard as to be likely to damage the various parts of the conditioning equipment 120 through which the unblocking material(s) must travel to reach the blockage(s).

In an embodiment in which the solid fuel is coal, it is currently preferred that an unblocking material be limestone, which is both harder and heavier than coal, but which also is still soft enough not to harm the metal-based component parts of the conditioning equipment 120. Moreover, limestone is brittle enough to break into pieces in transit within the conditioning equipment 120. These pieces will contain sharp/jagged edges, which, in turn, will more easily be able to push through and displace/dislodge the blocked solid fuel, thus curing a blockage.

In an embodiment in which the conditioning equipment is the Atrita® Pulverizer (see reference numeral 10 in FIG. 1), the limestone that is introduced into the inlet 60 is broken into pieces by, among other components, the swing hammer(s) 70. Therefore, by the time the limestone has made its way to a blockage site (which would most likely be present, if at all, in the grid portion 50 of the grinding section 30 of the Atrita® Pulverizer), its sharp pieces will be more apt to penetrate and successfully dislodge the solid fuel, thus curing the blockage.

Various unblocking materials can be introduced into conditioning equipment to cure or prevent a blockage. For example, one unblocking material can be introduced. Alternatively, two or more different unblocking materials can be simultaneously introduced or can be introduced separately at predetermined intervals and/or in response to predetermined conditions (e.g., certain pressure differential readings).

Moreover, the predetermined amount of the one or more unblocking materials can be introduced all at once, or gradually. According to a currently preferred embodiment of the present invention, a predetermined amount of one unblocking material is introduced substantially at once.

It takes time for the one or more unblocking materials to enter and travel through the conditioning equipment 120 to reach the blockage site(s). Thus, according to a currently preferred embodiment of the present invention, that duration should be factored into the timing of when to cause the one or more unblocking materials to be released from the supply device.

According to a currently preferred embodiment of the present invention, steps are taken to verify that the introduction of the unblocking material(s) has cured the blockage(s). To that end, one or more pressure differentials are assessed after a predetermined amount of the unblocking material(s) is/are introduced into the conditioning equipment. If the pressure differential is decreasing (i.e., if the pressure measurement(s) is/are approaching the baseline pressure), then that is indicative of the blockage being entirely or at least partially cured.

It is also currently preferred that the pressure differential be monitored periodically or continuously until a baseline pressure measurement is regained, and, further, that the pressure differential in the solid fuel conditioning equipment be assessed (e.g., periodically or at predetermined intervals) to prevent the recurrence of a blockage.

Although the present invention has been described herein with reference to details of currently preferred embodiments, it is not intended that such details be regarded as limiting the scope of the invention, except as and to the extent that they are included in the following claims—that is, the foregoing description of the present invention is merely illustrative, and it should be understood that variations and modifications can be effected without departing from the scope or spirit of the invention as set forth in the following claims. Moreover, any document(s) mentioned herein are incorporated by reference in their entirety, as are any other documents that are referenced within the document(s) mentioned herein.

What is claimed is:

1. A method of curing at least one solid fuel blockage within solid fuel conditioning equipment, comprising the steps of:

identifying that at least one fuel blockage of solid fuel is present within the solid fuel conditioning equipment by:

obtaining at least one pressure measurement within solid fuel conditioning equipment while solid fuel is being conditioned by the solid fuel conditioning equipment;

comparing the at least one pressure measurement to at least one baseline pressure measurement to determine at least one pressure differential; and determining that the at least one pressure differential is indicative of the presence of at least one solid fuel blockage; and causing an amount of at least one unblocking material to be introduced into the solid fuel conditioning equipment to cure the at least one solid fuel blockage.

2. The method of claim 1, where the at least one solid fuel blockage is a partial blockage.

3. The method of claim 1, where the at least one solid fuel blockage is a complete blockage.

4. The method of claim 1, wherein the solid fuel is selected from the group consisting of coal, coke and lignite.

5. The method of claim 4, wherein the solid fuel is coal selected from the group consisting of eastern bituminous coal, mid-western bituminous coal and sub-bituminous coal.

6. The method of claim 4, wherein the coke is delayed coke.

7. The method of claim 1, wherein the amount of the at least one unblocking material is greater when the at least one solid fuel blockage is a complete blockage than when the at least one solid fuel blockage is a partial blockage.

8. The method of claim 1, wherein the at least one pressure differential is a percentile-based measurement.

9. The method of claim 8, wherein a pressure differential in the range of about twenty-five percent to about fifty-percent is suggestive of the presence of at least one solid fuel blockage within the solid fuel conditioning equipment.

10. The method of claim 1, wherein the amount of the at least one unblocking material is in the range of about three pounds to about five pounds when the at least one solid fuel blockage is a complete blockage, and in the range of about one pound to about three pounds when the at least one solid fuel blockage is a partial blockage.

11. The method of claim 1, wherein the at least one unblocking material is heavier and harder than the solid fuel.

12. The method of claim 1, wherein the at least one unblocking material is limestone.

13. The method of claim 1, wherein the at least one blocking material is broken into a plurality of pieces after being caused to be introduced into the solid fuel conditioning equipment.

14. The method of claim 1, wherein the at least one pressure measurement is obtained by at least one inclinometer.

15. The method of claim 1, wherein the at least one pressure measurement is obtained at a solid fuel outlet of the solid fuel conditioning equipment.

16. The method of claim 1, wherein the at least one unblocking material is introduced into the solid fuel conditioning equipment via an inlet in which the solid fuel is also introduced into the solid fuel conditioning equipment.

17. The method of claim 1, wherein the step of causing an amount of at least one unblocking material to be introduced into the solid fuel conditioning equipment is accomplished by:

signaling a containment device to commence supplying the at least one unblocking material.

18. The method of claim 17, wherein the containment device is a screw feeder.

19. The method of claim 17, wherein the containment device is signaled by a programmable logic device.

20. The method of claim 1, wherein the steps of comparing the at least one pressure measurement to a baseline pressure measurement to determine at least one pressure differential and determining that the at least one pressure differential is indicative of the presence of at least one solid fuel blockage are accomplished by a programmable logic device that includes at least one application program for execution therein, wherein the at least one application program includes instructions and criteria for:

(a) controlling the receipt of electronic pressure signals; and (b) processing the electronic pressure signals.

21. The method of claim 1, wherein the at least one baseline pressure measurement is obtained while the solid fuel conditioning equipment is functioning.

22. The method of claim 21, wherein the at least one baseline pressure measurement is obtained while the solid fuel conditioning equipment is functioning at substantially full load.

23. The method of claim 1, wherein the at least one baseline pressure measurement is obtained at a solid fuel outlet of the solid fuel conditioning equipment.

24. The method of claim 1, further comprising the step of:

after the at least one unblocking material has been caused to be introduced into the solid fuel conditioning equipment, verifying that the at least one solid fuel blockage has been cured.

25. The method of claim 24, wherein the verifying step is accomplished by:

obtaining a plurality of post-treatment pressure measurements within the solid fuel conditioning equipment;

comparing the plurality of pressure measurements to a baseline pressure measurement to determine a plurality of post-treatment pressure differentials; and determining whether the plurality of post-treatment pressure differentials are approaching the baseline pressure.

26. A method of preventing the formation of a solid fuel blockage within solid fuel conditioning equipment, comprising the steps of:

obtaining a plurality of pressure measurements within solid fuel conditioning equipment, wherein the plurality of pressure measurements are obtained (a) while solid fuel is being conditioned by the solid fuel conditioning equipment, and (b) over a predetermined time period;

comparing the plurality of pressure measurements to a baseline pressure measurement to determine a plurality of pressure differentials; and confirming that the plurality of pressure differentials are approaching a predetermined pressure differential threshold; and causing an amount of at least one unblocking material to be introduced into the solid fuel conditioning equipment to prevent the occurrence of a solid fuel blockage.

27. The method of claim 26, wherein the predetermined pressure threshold is a percentile-based threshold.

28. The method of claim 27, wherein the predetermined pressure threshold is in the range of about ten percent to about twenty percent of the baseline pressure measurement.

* * * * *